United States Patent [19]

Davis

[11] 4,285,532

[45] Aug. 25, 1981

[54] BOOK MARKER

[75] Inventor: Charles S. Davis, 418 Laughton St., Antioch, Calif. 94509

[73] Assignee: Leonard Russo, San Rafael, Calif.

[21] Appl. No.: 99,149

[22] Filed: Nov. 30, 1979

[51] Int. Cl.[3] ..... B42D 9/00; A47B 97/04

[52] U.S. Cl. ..... 281/42; 281/45; 248/451

[58] Field of Search ..... 281/42, 45, 46–50; 24/67.1; 248/451, 454, 448; 403/122

[56] References Cited

U.S. PATENT DOCUMENTS

| | | | |
|---|---|---|---|
| 1,057,004 | 3/1913 | Michel | 24/67.1 X |
| 1,067,927 | 7/1913 | Knowles | 281/42 X |
| 1,947,053 | 2/1934 | Mason | 248/454 X |
| 1,959,843 | 5/1934 | Sprague | 248/451 X |
| 2,699,748 | 1/1955 | Crawford | 281/42 X |
| 3,227,415 | 1/1966 | Fisher | 403/122 X |
| 3,661,405 | 5/1972 | Brown | 281/42 |
| 3,889,914 | 6/1975 | Torme | 248/451 X |
| 4,047,688 | 9/1977 | Knox et al. | 248/451 |

*Primary Examiner*—Paul A. Bell
*Assistant Examiner*—John S. Brown

[57] ABSTRACT

A book marker useful to mark a page in a book as well as hold a page down while the book is being read is disclosed. The device has a frame which supports and guides a pair of cover engaging members. These markers have elongated C-shaped portions which hook over the upper and lower edges of a book cover and are biased towards one another. An arm is pivotally attached to an outer corner of one of the C-shaped portions. The end of the arm has a swingable page marker extending over the page of the book. Preferably this page marker is a thin stiff wire that minimizes any obstructions to reading the book. The arm is spring loaded causing the page marker to press against the page. This page marker can be swung out of the way when desired, for example when the book is first mounted or when a great number of pages are to be advanced. The device assists the reader by keeping the pages on one side of the book held down during reading, as well as marking the place when the book is closed.

5 Claims, 3 Drawing Figures

BOOK MARKER

This invention relates to an improved book marker useful for marking a page in a book and also useful for holding the book open to a chosen place.

DESCRIPTION OF THE PRIOR ART

Page marking, reading aids can be divided into two main categories: page markers and book stands. A simple strip of paper is a common example of a page marker. Contrasted therewith are book stands, generally relatively large devices, which provide support for an open book. (See, for example, U.S. Pat. Nos. 3,227,415 and 1,057,004.)

Both types have their shortcomings. Book stands often work well at a desk or on a kitchen counter. However, they are not suitable for use in many situations, such as on a bus; nor are they extremely portable, as the book itself is portable.

Book markers do a fine job of marking the page where the reader stopped; however, they do not help hold the book open and they are often lost.

SUMMARY OF THE INVENTION

The present invention solves many of the problems left unsolved by the prior art reading aids. A book marker useful to mark a page in a book, as well as hold a page down while the book is being read, is disclosed. The device has a frame which supports and guides a pair of cover engaging members. Elongated C-shaped cover engaging portions of the cover engaging members hook over the upper and lower edges of a book cover and are held in place by a tension spring pulling the plates towards one another. An arm is pivotally attached to an outer corner of one of the cover engaging members. The free end of the arm has a page marker for extension back over the page of the book. Preferably this page marker is a thin but stiff wire so as not to hinder reading of the book. The arm is spring loaded causing the page marker to press against the page. This page marker can be swung out of the way when desired, for example when the book is first mounted or when a great number of pages are to be advanced. The device assists the reader by keeping the pages on one side of the book held down during reading, as well as marking the reader's place when the book is closed.

An object of this invention is to provide the user with a device which combines the portability of a page marker with the page control of a book stand. This allows the user to attach the invention to one or both covers of a book and still not add any significant size or weight to the book.

The invention also provides a pivoting arm which has a page marker or wire extending from its end. This allows the device to act as a page marker when the book is closed and also act as a very portable book stand for holding down the pages of the book when open. Depending upon the desires of the user, one or two markers can be used to hold back the pages. This aspect of the invention is particularly useful when reading while standing on a crowded bus; only one hand is available to hold the book because the other is used to grip a handhold. Also the page wire allows successive pages to be easily slipped under it as the reader progresses. Use of a thin wire as the page marker also obscures very little of the printed page.

Additional objects and features of the invention will appear from the following description in which the preferred embodiment has been set forth in detail in conjunction with the accompanying drawings.

DESCRIPTION OF THE PREFERRED EMBODIMENTS

Figure 1:
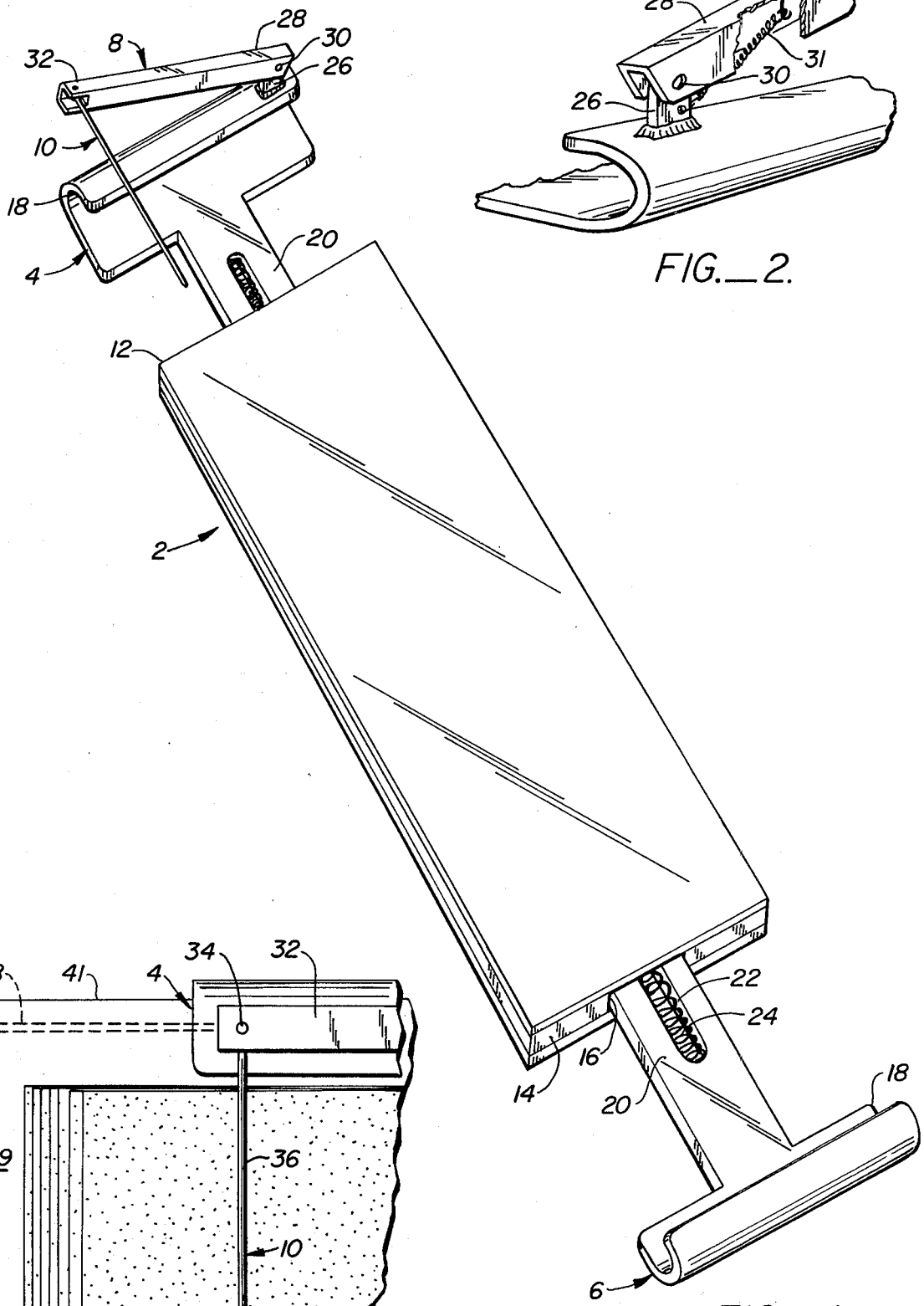
FIG. 1 is a perspective view of the assembled device with the cover engaging members extended.

Referring primarily to FIG. 1, the device is seen as generally comprising a frame 2, a pair of cover engaging members, upper 4 and lower 6, an arm 8 and a page marker (or wire) 10. The following discussion will first address the structure of the invention. The function and interaction of the elements will subsequently be discussed.

Frame 2 is a rectangularly-shaped planar member having a top end 12 and a bottom end 14. A relatively long, narrow rectangular passageway 16 is formed centrally within frame 2 so that the ends of passageway 16 pass through the centers of ends 12, 14. The internal passageway surfaces are generally parallel to the external surfaces of the frame 2.

Upper and lower cover engaging members 4, 6 have elongated C-shaped cover-engaging portions 18 sized for engagement over the edge of the cover of a book. Attached centrally to the extended lower edge of portion 18 are biasing portions 20. Portions 20 are rectangular members sized for slidable engagement within passageway 16. Centrally within and longitudinally along each portion 20 is a slot 22. Slot 22 is open at the end of portion 20 farthest from portion 18. The ends of a tension spring 24 are attached to the ends of slots 22 nearest portions 18. Attachment is typically through the use of an appropriate adhesive. Screws, solder or other attachment means can also be used.

It is readily apparent that the above structure allows frame 2 to be held against the cover of a book by merely placing portions 18 of upper and lower cover engaging members 4, 6 over the edge of the book. Springs 22 urge portions 18 toward one another thereby capturing the upper and lower edges of the book securely therebetween. Springs 22 are sized to remain in a tensive state over a range of different sized book covers. Other biasing means, such as an elastic band, could be used in lieu of spring 22. Also, only one member 4, 6 needs to be biased so long as the other member's movement is appropriately limited. If desired, one cover engaging portion may be formed as an integral part of the frame so that only a single cover engaging portion is movable relative to the frame.

Figure 2:
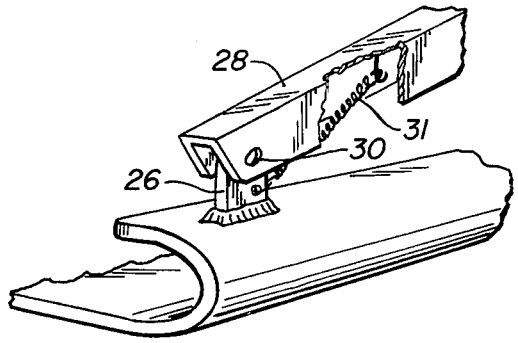
FIG. 2 is a perspective view of the pivot end of the arm.

One end of arm 8 is pivotally attached at the outer edge of portion 18 of upper cover engaging member 4. As seen best at FIG. 2, a short pivot post 26 extends upwardly from the outer edge of portion 18 of member 4 and into the pivot end 28 of arm 8 where arm 8 is pivotally attached to post 26 by a pin 30. Thus, arm 8 can pivot in a plane which is generally normal to frame 2. Biasing of arm 8 towards portion 18 of member 4 is accomplished by a spring 31 mounted within pivot end 28 of arm 8.

Figure 3:
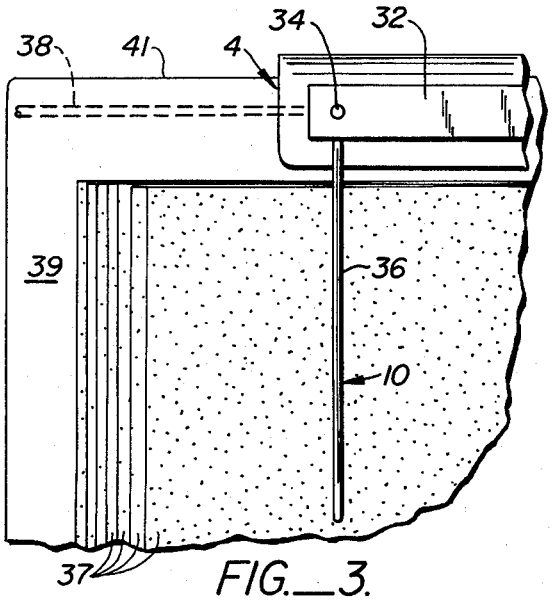
FIG. 3 is a top view of the free end of the arm showing a book engaged by the invention.

Page wire 10 is pivotally attached to the free end 32 of arm 8. Wire 10 extends outwardly from arm 8 and pivots in a plane which is parallel to the axis of arm 8. As seen best at FIG. 3, wire 10 is frictionally mounted to free end 32 using a pin 34. Wire 10, in this preferred embodiment, can pivot about pin 34 through an angle of approximately 90 degrees from a first position 36 extending over the pages 37 of a book 39 to a second position 38 parallel to the upper edge 41 of book 39. The frictional mounting of wire 10 at pin 34 insures that wire 10 will stay in place until repositioned by the user. The coupled action of arm 8, biased toward upper portion 18 of member 4, with wire 10, in position 36 over the pages 37 of book 39, acts to both mark the user's place in the book and keep the pages under wire 10 pressed against the cover of the book.

To use the device one simply first hooks the cover engaging portions 18 of upper and lower cover engaging members 4, 6 over the upper and lower edges of the book. Portions 18 remain snugly engaged because of the tensive forces exerted on them by spring 24.

To hold a page in place, one merely slips it under page wire 10. The book may be closed and the place marked. If a number of pages are to be advanced, the user pivots page wire 10 from first position 36 to second position 38. Once wire 10 has cleared the pages, the new group of pages are advanced. Arm 8 is lifted to an appropriate height, wire 10 is swung back over the pages to position 36, and arm 8 is released thereby holding the pages of the book down and in place.

It should be noted that the ability of the page marker 10 to rotate out of the way of the pages of the book gives the device flexibility in its use which it would not have if it were fixed to the arm. If desired, two book marker can be used, one on each cover.

Thus, although the best mode contemplated for carrying out the present invention has been herein shown and described, it will be apparent that modification and variation may be made without departing from what is regarded to be the subject of the invention.

What is claimed is:

1. A device for marking the user's place in a book and for holding the pages of the book down, said book having a bookcover, comprising:

a frame;

first and second cover engaging members attached to said frame, at least one of said members being movably attached to said frame;

said members having means for engaging the opposed edges of said book cover;

means for biasing said members towards each other whereby said book cover is captured between saidd engaging means;

an arm pivotably attached at one end to said first cover engaging member; and a page marker pivotally attached to said arm whereby when said device is secured to said bookcover, said page marker can be disposed in a first position extending over and in physical contact with at least one page of said book to cause said at least one page to be held between said page marker and said frame or a second position out of physical contact with said at least one page.

2. The book marker of claim 1 wherein said arm is biased to pivot towards said securing means.

3. The book marker of claim 1 wherein said biasing means is a tension spring mounted between said cover engaging members.

4. A mechanical book marker comprising:

a frame;

a lower cover edge engaging member adapted for slidable engagement with said frame, said lower member having an outer end and an inner end;

an upper cover edge engaging member adapted for slidable engagement with said frame, said upper member having an outer end and an inner end;

said lower and upper members having opposed lower and upper cover engaging portions, said engaging portions formed to fit over the lower and upper edges of the cover of a book;

means for biasing said lower and upper cover engaging members towards each other whereby the cover of said book is captured between said lower and upper cover engaging portions;

an arm pivotably connected to at least one said cover engaging portion and having a pivot end and a free end and biased to have the free end pivot towards said at least one cover engaging portion; and a page wire pivotally attached to said free end, said wire being pivotable in a plane parallel to the axis of said arm.

5. The device of claim 4 wherein:

said page wire has a first position extending over the page of the book so that the page of the book is urged against the cover of the book by the action of the biased arm; and said page wire has a second position generally parallel to the extend outwardly from the axis of said arm whereby the pages of the book are free to turn.

* * * * *